US005086746A

United States Patent [19]

Albertson

[11] Patent Number: 5,086,746

[45] Date of Patent: Feb. 11, 1992

[54] COMPRESSED AIR SUPPLY

[75] Inventor: William C. Albertson, Sterling Heights, Mich.

[73] Assignee: General Motors Corporation, Detroit, Mich.

[21] Appl. No.: 677,194

[22] Filed: Mar. 29, 1991

[51] Int. Cl.[5] ..... F02B 13/08

[52] U.S. Cl. ..... 123/533; 123/179.25; 123/179.28

[58] Field of Search ..... 123/531, 533, 179 D, 123/179 L, 179 M

[56] References Cited

U.S. PATENT DOCUMENTS

| | | | |
|---|---|---|---|
| 3,082,597 | 3/1963 | Hamblin | 60/290 |
| 4,347,813 | 9/1982 | Maucher et al. | 123/179 M |
| 4,517,466 | 5/1985 | Ogawa | 123/179 D |
| 4,543,923 | 10/1985 | Hamano et al. | 123/179 M |
| 4,754,740 | 7/1988 | Emmenthal et al. | 123/533 |
| 4,771,754 | 9/1988 | Reinke | 123/533 |
| 5,009,212 | 4/1991 | Bishai | 123/533 |

FOREIGN PATENT DOCUMENTS

| | | | |
|---|---|---|---|
| 0081115 | 5/1982 | Japan | 123/533 |
| 8808082 | 10/1988 | World Int. Prop. O. . | |

*Primary Examiner*—Willis R. Wolfe
*Attorney, Agent, or Firm*—Charles K. Veenstra

[57] ABSTRACT

An engine, having a fuel injection system in which compressed air carries the fuel into the engine, is equipped with an air compressor coupled to and driven by the engine cranking motor; the air compressor supplies supplementary air required by the fuel injection system for prompt starting of the engine.

2 Claims, 1 Drawing Sheet

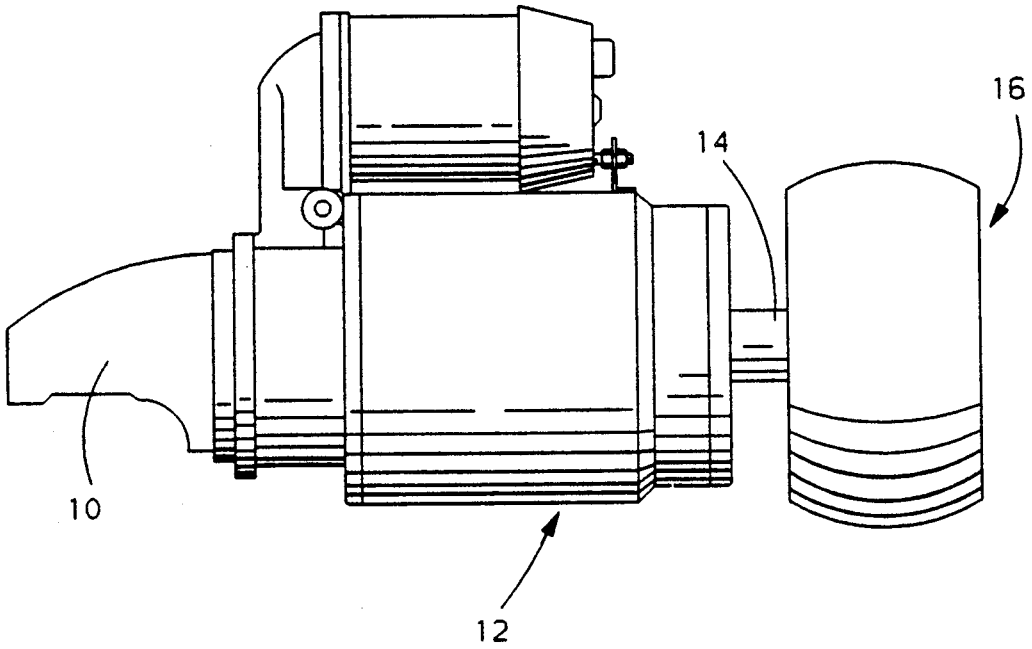
16
14
10
12

COMPRESSED AIR SUPPLY

TECHNICAL FIELD

This invention relates to the supply of compressed air to an air-assisted fuel injection system.

BACKGROUND

Air-assisted fuel injection systems proposed for use on two-stroke engines employ a fuel metering injector that delivers metered fuel to a charge delivery injector. Compressed air is supplied to the charge delivery injector, and when the charge delivery injector is energized, the compressed air carries the fuel into the engine combustion chamber.

The compressed air is usually supplied by an air compressor driven from the engine crankshaft. The air compressor must supply the air required over the entire range of engine operating speeds and thus in many applications must be capable of supplying the required air at engine speeds in excess of 6000 rpm.

An air-assisted fuel injection system supplied by an engine driven air compressor is shown, for example, in international publication WO 88/08082 published 20 Oct. 1988 in the name of P. W. Ragg. As explained there, air compressors capable of supplying the required air flow at high engine speeds may operate inefficiently at the very low engine speeds associated with cranking or starting the engine. When the air compressor is inefficient, an undesirably long period of time may be required to create the pressure in the air supply system necessary for proper fueling of the engine. As a result, a delay in starting the engine may be encountered.

SUMMARY OF THE INVENTION

This invention provides an additional compressed air source that supplies the supplementary air required for prompt starting of such an engine.

The supplementary air is supplied by an additional air compressor coupled to and driven by the engine cranking motor armature. The cranking motor armature typically operates at speeds perhaps fifteen times the engine crankshaft speed, and in some applications may rotate even before the engine crankshaft begins to rotate.

Thus with this invention, the air-assisted fuel injection system is quickly supplied with the air necessary for promptly starting the engine.

The details as well as other features and advantages of one embodiment of this invention are set forth in the remainder of the specification and are shown in the accompanying drawing.

SUMMARY OF THE DRAWING

The sole figure of the drawing shows a supplementary air compressor coupled to an engine cranking motor as provided by this invention.

THE PREFERRED EMBODIMENT

Referring to the drawing, the housing 10 at the left end of an engine cranking motor 12 is adapted to fit adjacent a flywheel ring gear secured to the engine crankshaft. When cranking motor 12 is energized, a pinion is advanced to engage the ring gear, and an armature is rotated to spin the pinion and ring gear and thereby crank the engine for starting. Such structure and operation are conventional and well known.

The armature is mounted on a shaft that, for the purpose of this invention, has an extension 14 projecting from the right end of motor 12. An air compressor 16 is operated by shaft extension 14. As the armature shaft rotates to crank the engine for starting, air compressor 16 supplies the supplementary air required by the fuel injection system for prompt starting of the engine.

As soon as the engine starts, cranking motor 12 is de-energized, air compressor 16 stops supplying supplementary air to the fuel injection system, and the engine driven air compressor then supplies all air required by the fuel injection system.

Reference may be made to the aforementioned publication WO 88/08082 for other details of the fuel injection system and the engine driven air compressor.

I claim:

1. The method of supplying air to an air-assisted fuel injection system for a combustion engine which includes the steps of supplying air from a principal air compressor to the fuel injection system during normal engine operation, driving a supplementary air compressor from an engine cranking motor while the cranking motor cranks the engine, and supplying air from the supplementary air compressor to the fuel injection system to facilitate prompt starting of the engine.

2. In a fuel injection system requiring air to carry fuel into an engine having a cranking motor, a principal air compressor to supply air during normal engine operation, and a supplementary air compressor coupled to the cranking motor and driven by the cranking motor to supply air that enables the fuel injection system to facilitate prompt starting of the engine.

* * * * *